US008453950B2

(12) United States Patent
Dennis

(10) Patent No.: US 8,453,950 B2
(45) **Date of Patent: *Jun. 4, 2013**

(54) HOSE SPRAYER WITH INTEGRAL DIP TUBE

(75) Inventor: Stephen R. Dennis, Danville, CA (US)

(73) Assignee: The Clorox Company, Oakland, CA (US)

( * ) Notice: Subject to any disclaimer, the term of this patent is extended or adjusted under 35 U.S.C. 154(b) by 234 days.

This patent is subject to a terminal disclaimer.

(21) Appl. No.: 13/020,657

(22) Filed: Feb. 3, 2011

(65) Prior Publication Data

US 2011/0163184 A1 Jul. 7, 2011

Related U.S. Application Data

(63) Continuation-in-part of application No. 12/616,282, filed on Nov. 11, 2009.

(51) Int. Cl.
*B05B 7/28* (2006.01)
*B05B 7/30* (2006.01)

(52) U.S. Cl.
USPC ..... 239/318; 239/317; 222/382

(58) Field of Classification Search
USPC ..... 222/317, 318, 382; 239/317, 318
See application file for complete search history.

(56) References Cited

U.S. PATENT DOCUMENTS

| | | | | |
|---|---|---|---|---|
| 2,536,361 | A | 1/1951 | Flanders | |
| 4,475,689 | A | 10/1984 | Hauger et al. | |
| 4,863,071 | A | 9/1989 | Guss et al. | |
| 5,183,206 | A | 2/1993 | Gavin | |
| 5,246,146 | A | 9/1993 | Bartimes et al. | |
| 5,337,928 | A | 8/1994 | Foster et al. | |
| 5,464,129 | A * | 11/1995 | Ho | 222/377 |
| 6,702,157 | B1 | 3/2004 | Dobbs | |
| 6,869,028 | B2 | 3/2005 | Bartsch et al. | |
| 7,032,841 | B1 * | 4/2006 | Swisher | 239/375 |
| 7,325,706 | B2 | 2/2008 | Sweeton et al. | |
| 7,478,739 | B2 | 1/2009 | Foster | |
| 7,490,743 | B2 | 2/2009 | Herzog | |
| 7,703,703 | B2 | 4/2010 | Gavin | |
| 2010/0096415 | A1 | 4/2010 | Dennis | |

* cited by examiner

*Primary Examiner* — Kevin P Shaver
*Assistant Examiner* — Nicholas J Weiss
(74) *Attorney, Agent, or Firm* — Thomas C. Feix

(57) ABSTRACT

Described is a fluid dispensing container having a bottle and fluid withdrawing assembly for liquids, such as liquid cleaners and the like. The bottle has an integral dip tube formed therein connecting at a landing below the top of the bottle neck, fluidly connecting the inside of the bottle with the top opening of the bottle. A fluid dispensing mechanism, such as a hose sprayer, is attached to the top of the bottle to take fluid up through the integral dip tube and dispense the fluid accordingly. The fluid dispensing mechanism may be aligned to allow a direct connection between integral dip tube and the fluid dispensing mechanism at a landing below the bottle opening. The fluid dispensing mechanism may be attached to the bottle with a snap-fit connection.

19 Claims, 11 Drawing Sheets

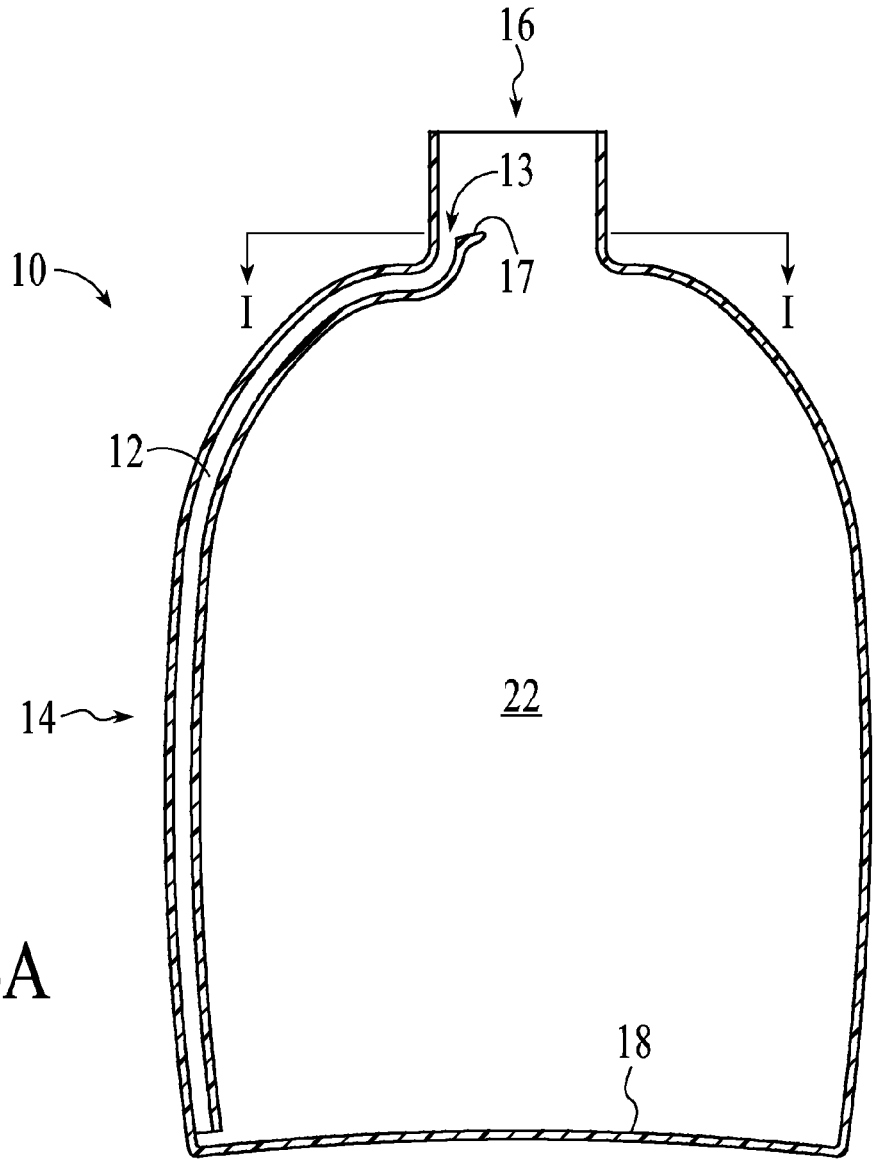
FIG.4A
FIG.4B
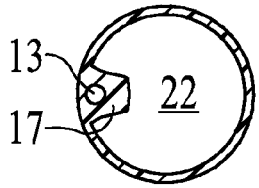

HOSE SPRAYER WITH INTEGRAL DIP TUBE

CROSS REFERENCE TO RELATED APPLICATIONS

This application is a continuation-in-part of U.S. patent application Ser. No. 12/616,282, filed Nov. 11, 2009.

BACKGROUND OF THE INVENTION

1. Field of the Invention

This invention relates generally to containers and fluid withdrawing assemblies for liquids, such as liquid cleaners and the like. More particularly, the present invention relates generally to bottles having an integral dip tube formed therein. In particular, the present invention relates to the connection of a hose sprayer to a bottle with a snap-on fitment and connection to an integral dip tube.

2. Description of the Related Art

Various types of nozzle assemblies are known. A typical nozzle assembly is adjustable to provide different discharge patterns of the fluid dispensed from the sprayer housing. For example, the fluid can be dispensed in a stream or spray pattern, or as a foam.

A sprayer connector, adapted to secure the sprayer housing to the fluid container, is typically integrally formed with or otherwise coupled to the sprayer housing. As noted above, the sprayer connector includes a connector aperture therethrough that forms the inlet opening of the fluid supply passageway to the pump chamber of the sprayer housing. A dip tube is often sealingly coupled to the connector aperture. The dip tube extends through a neck of the container and into fluid contents of the container. The dip tube fluidly communicates the container with the fluid supply passageway of the sprayer housing.

A hose sprayer has the sprayer dispenser from the container operable using a hose fluidly communicating the sprayer dispenser and the liquid within the container. For hose sprayers it may be advantageous to easily connect the sprayer to the container and to disconnect the sprayer from the container. With conventional dip tubes, some liquid is typically spilled when removing the dip tube and sprayer from the container. Since the container may often be refilled, it is useful to additionally be able to get the last amount of the prior liquid contents out of the container before adding fresh contents. It may also be important to get the last amount of liquid contents if the liquid has toxic properties, such an insecticide or herbicide, products commonly sold with a hose sprayer. Sprayer connectors with conventional dip tubes present problems. Warped dip tubes are currently a major problem in the pump/bottle assemblies with a resultant non-functioning dip tube or dip tube that no longer efficiently primes refilled contents. The elimination of the conventional dip tube may eliminate this major problem. Having a hose sprayer which mates to a container with a blown-in dip tube solves several problems of potential spillage and complete product usage.

U.S. Pat. No. 6,050,459 discloses a rigid dip tube connector for a trigger spray bottle having a threaded opening. U.S. Pat. No. 4,863,071 discloses a pump and container assembly which includes a dip tube which is carried by the pump and extends through a customary circular cross sectional mouth of the container. The container includes an offset supply tube for carrying the liquid from the integral dip tube to the pump assembly. Furthermore, the pump assembly may be attached to the bottle via a screw cap, thereby requiring the offset supply tube to be properly aligned with the integral dip tube prior to screwing the cap to attach the pump assembly to the bottle. To assist in this alignment, an upstanding projection may be formed in the container to prevent twisting of the pump assembly relative to the container when the screw cap is tightened. The requirements of an upstanding projection and offset supply tube may result in additional manufacturing cost. Without such an upstanding projection, the torque of tightening the screw cap onto the bottle may misalign the integral dip tube from the offset supply tube.

As discussed above, many prior art hose sprayers, including those useful with bottles having integral dip tubes, are connected to their containers by an internally threaded sprayer connector. To firmly secure the hose sprayer on the container neck, the sprayer connector is positioned on the container neck and rotated. Complementary screw threading provided on the inner surface of the cap and the outer surface of the container neck securely attaches the sprayer to the container. These containers require a two-step process for attaching the sprayer to the container neck—a first step of aligning the dip tube with the sprayer and a second step of screwing the sprayer onto the container neck to form a seal.

Alternatively, many sprayers are connected to a container with a bayonet sprayer connector, such as disclosed in U.S. Pat. No. 7,478,739, and incorporated in its entirety herein. Bayonet sprayer connectors are advantageously used where a sprayer is connected to a container neck by a machine in an assembly line. Bayonet sprayer connectors of the prior art may be the well known "snap fit" type sprayer connectors that firmly attach the sprayer on the container neck by merely positioning the sprayer housing above and in alignment with the container and, with the dip tube inserted through the open top of the container, pushing the sprayer down on the container. Bayonet sprayer connectors typically use a standard dip tube, depending from the sprayer connector. Thus, the problems associated with standard dip tubes, as discussed above, may apply to the typical bayonet sprayer connectors currently in use.

Several prior art bayonet sprayer connectors are connected to complementary container necks by rotating the connector just a fraction of one complete revolution relative to the container neck. These types of bayonet sprayer connectors have two different movements to attach the sprayer connector on a container neck. The sprayer connector must be moved in a linear direction onto the container neck while also being rotated relative to the container neck. For bayonet connectors, the rotation of the sprayer connector relative to the container neck after alignment of the supply tube with the integral dip tube could create problems in maintaining that alignment and connection with the integral dip tube.

Accordingly, what is needed is a bottle, with an integral dip tube, having a sprayer or pump assembly that attaches to the bottle without the alignment issues of prior art sprayers or pump assemblies.

SUMMARY OF THE INVENTION

In accordance with the principles of the present invention, in one embodiment, a fluid dispensing container comprises fluid dispensing container comprising a bottle having a front side surface, a back side surface, a bottom, a neck top, a bottle fitment below the neck top, and an interior volume, wherein a dip tube is integrally formed exterior to the front side surface, separated from the front side surface by a partition, and fluidly connected to the interior volume at the bottom and fluidly connected to the interior volume at a landing below the neck top; and a hose sprayer assembly having a snap-fit dispensing attachment assembly attached to the bottle neck by a snap-fit fitting and fluidly connected to the dip tube at the landing and a hose connector, wherein the dispensing attachment assembly is fluidly connected to a mixing chamber of the sprayer assembly.

According to a further embodiment of the present invention, a fluid dispensing container comprises fluid dispensing container comprising a bottle having a front side surface, a back side surface, a bottom, a neck top, a bottle fitment below the neck top, and an interior volume, wherein a dip tube is integrally formed to the front side surface and fluidly connected to the interior volume at the bottom and fluidly connected to the interior volume at a landing below the neck top; and a hose sprayer assembly having a snap-fit dispensing attachment assembly attached to the bottle neck by a snap-fit fitting and fluidly connected to the dip tube at the landing wherein the landing is funnel shaped, instead of flat, with one or both sides of the landing slanting inward towards a dip tube top opening and wherein the dispensing attachment assembly is fluidly connected a mixing chamber of the sprayer assembly.

According to a further embodiment of the present invention, a fluid dispensing container comprises fluid dispensing container comprising a bottle having a front side surface, a back side surface, a bottom, a neck top, a bottle fitment below the neck top, and an interior volume, wherein a dip tube is integrally formed exterior to the front side surface, separated from the front side surface by a partition, and fluidly connected to the interior volume at the bottom and fluidly connected to the interior volume at a landing below the neck top; a hose sprayer assembly having a snap-fit dispensing attachment assembly attached to the bottle neck by a snap-fit fitting and fluidly connected to the dip tube at the landing wherein the landing is funnel shaped, instead of flat, with one or both sides of the landing slanting inward towards a dip tube top opening and wherein the dispensing attachment assembly is fluidly connected to a mixing chamber of the sprayer assembly wherein the snap-fit dispensing attachment assembly includes a separate flexible connector fluidly connecting the hose dispensing mechanism with the dip tube at the landing.

The use of the bottle of the present invention, from a consumer perspective, would not differ from the use of any conventional hose sprayer bottle known in the art. The user would simply activate the fluid dispensing mechanism to dispense fluid from the bottle.

In one embodiment, the bottle may include a snap-fit fluid dispensing mechanism, such as a pump or a trigger sprayer, for dispensing fluid from the container. By using a snap-fit mechanism instead of a screw-type mechanism, alignment and sealing attachment of the mechanism to the container may be achieved in a single motion. This is in contrast to the prior art screw-type mechanisms, where attachment of the mechanism to the container includes at least a first motion of alignment, which includes maintaining this alignment throughout a second motion of rotation to tighten the mechanism on the container to form a seal.

The snap-fit fluid dispensing mechanism of the present invention may have alignment means, such as tabs and slots, to fit the trigger over the opening of the container so as to align the integral dip tube of the container with the fluid supply into the trigger or pump mechanism. In one embodiment, the trigger or pump mechanism may be designed such that the integral dip tube of the container may directly align with the fluid supply into the trigger or pump mechanism, without the need for an offset tube to fluidly connect the trigger or pump mechanism with the integral dip tube.

In yet another embodiment of the present invention, the snap-fit fluid dispensing mechanism may be a removable snap-fit mechanism, allowing the user to refill and reuse the bottle. In another embodiment of the present invention, the snap-fit mechanism may be a non-removable snap-fit mechanism. In a further embodiment, the snap-fit mechanism may be either a removable or non-removable snap-fit mechanism having a refill channel provided therethrough.

In one embodiment, the fluid dispensing container comprises a bottle having a front side surface, a back side surface, a bottom, a neck top, a bottle fitment below the neck top, and an interior volume, wherein a dip tube is integrally formed exterior to the front side surface, separated from the front side surface by a partition, and fluidly connected to the interior volume at the bottom and fluidly connected to the interior volume at a landing below the neck top; and a snap-fit dispensing mechanism attached to the bottle neck by a snap-fit fitting and fluidly connected to the dip tube at the landing, wherein the fluid dispensing mechanism includes a supply line directly connecting with the integral dip tube when the fluid dispensing mechanism is attached to the bottle; wherein the distance between the neck top and the landing is equal to or greater than the bottle fitment length.

In one embodiment, the fluid dispensing container comprises a bottle having a front side surface, a back side surface, a bottom, a neck top, a bottle fitment below the neck top, and an interior volume, wherein a dip tube is integrally formed to the front side surface and fluidly connected to the interior volume at the bottom and fluidly connected to the interior volume at a landing below the neck top; and a snap-fit trigger dispensing mechanism attached to the bottle neck by a snap-fit fitting and fluidly connected to the dip tube at the landing.

In one embodiment, the fluid dispensing container comprises a bottle having a front side surface, a back side surface, a bottom, a neck top, and an interior volume, wherein a dip tube is integrally formed to the front side surface and fluidly connected to the interior volume at the bottom and fluidly connected to the interior volume at a landing below the neck top; and a snap-fit trigger dispensing mechanism attached to the bottle neck by a snap-fit fitting and fluidly connected to the dip tube at the landing, wherein the fluid dispensing mechanism includes a supply line directly connecting with the integral dip tube when the fluid dispensing mechanism is attached to the bottle.

Further features and advantages of the present invention will become apparent to those of ordinary skill in the art in view of the detailed description of embodiments below, when considered together with the attached drawings and claims.

BRIEF DESCRIPTION OF THE DRAWINGS

The foregoing aspects and others will be readily appreciated by the skilled artisan from the following description of illustrative embodiments when read in conjunction with the accompanying drawings, in which:

FIG. 4A shows a cross-sectional view of a fluid dispensing mechanism having an integral dip tube, according to the present invention;

FIG. 4B shows a plan view of the bottle of FIG. 4A taken along line I-I of FIG. 4A;

DETAILED DESCRIPTION

Figure 1:
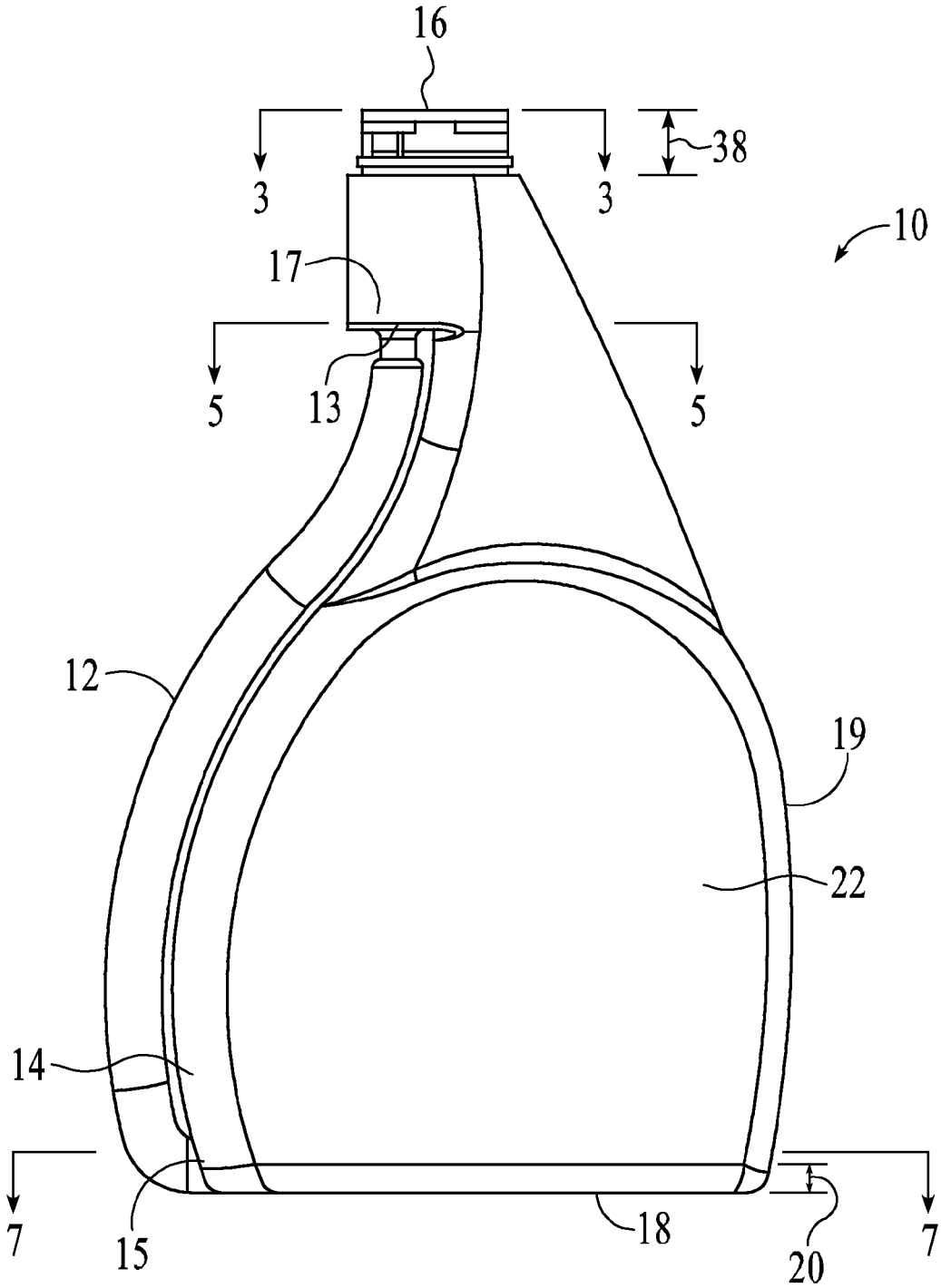
FIG. 1 shows a side view of a bottle having an integral dip tube in accordance with an embodiment of the present invention.

Reference will now be made to the drawings wherein like numerals refer to like parts throughout. For ease of description, the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The term "bottle", as used herein, is meant to mean and include any container for holding a fluid. A bottle may be made of any suitable material, depending upon the product therein. For example, a bottle may be made of plastic.

The term "integral dip tube", as used herein, is meant to mean and include any channel formed integrally along the structure of a bottle that may carry the fluid present in the bottle. An integral dip tube may be a channel formed in a bottle running from near a top opening in the bottle, along a side wall of the bottle, and ending near the bottom interior of the bottle.

Broadly, the present invention provides a bottle and fluid withdrawing assembly for liquids, such as liquid cleaners and the like. The bottle has an integral dip tube formed therein, fluidly connecting the bottom, front inside of the bottle with a connection point near the top opening of the bottle. A fluid dispensing mechanism, such as a sprayer, may be attached to the top of the bottle to take fluid up through the integral dip tube and dispense the fluid accordingly, where the fluid is sprayed from the sprayer above the front side of the bottle. The fluid dispensing mechanism may be aligned to allow a direct connection between the integral dip tube and the fluid dispensing mechanism. The fluid dispensing mechanism may be attached to the bottle with a snap-fit connection.

Referring to FIG. 1, there is shown a side view of an exemplary bottle 10 in accordance with the present invention. The bottle 10 may include an integral dip tube 12 formed as a channel along the front side wall 14 of the bottle. The integral dip tube 12 may extend along the front side wall 14 from a dip tube top opening 13 at a landing 17 below the bottle top opening 16 of the bottle 10 to a dip tube bottom opening 15 near the bottom 18 of the bottle 10. The integral dip tube 12 may stop a distance 20 from the bottom 18 of the bottle 10 so as to be in fluid communication with an inside 22 of the bottle 10. The distance 20 may be selected so that a bottom end 24 of the integral dip tube 12 is far enough from the bottom 18 such that fluid in the bottle may be taken up through the integral dip tube 12. The distance 20 may be further selected so that the bottom end 24 is not too far from the bottom 18 of the bottle 10 such that there may remain fluid in the bottle 10 that is unable to be taken up through the integral dip tube 12. Typically, the distance 20 may be from about 0.5 to about 3 times a diameter 26 of the integral dip tube 12 (FIG. 3).

Figure 2A:
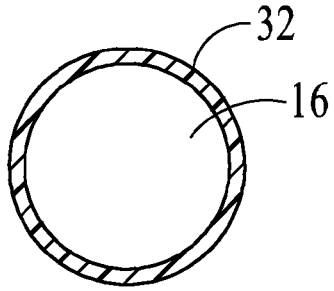
FIG. 2A shows a plan view of the bottle of FIG. 1 taken along line 3-3 of FIG. 1.
Figure 2B:
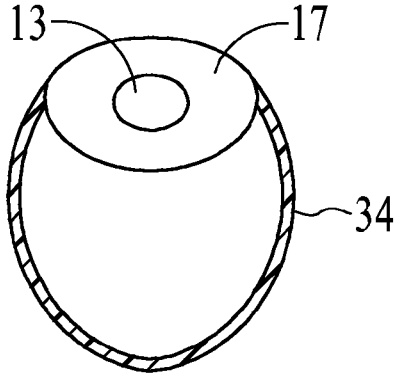
FIG. 2B shows a plan view of the bottle of FIG. 1 taken along line 5-5 of FIG. 1.
Figure 2C:
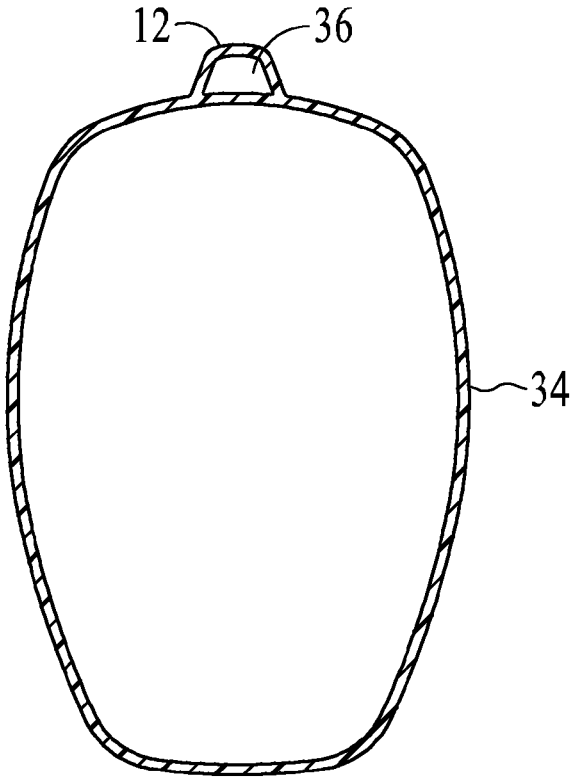
FIG. 2C shows a plan view of the bottle of FIG. 1 taken along line 7-7 of FIG. 1.

FIG. 2A is a plan view of the bottle taken generally along the line 3-3 of FIG. 1, showing the neck top 32 and the bottle top opening 16. FIG. 2B is a plan view of the bottle taken generally along the line 5-5 of FIG. 1, showing the dip tube top opening 13, the landing 17, and the bottle side wall 34. The landing is funnel shaped, instead of flat, with one or both sides of the landing slanting inward towards the dip tube top opening 13. This facilitates high speed assembly of the bottle and the sprayer dispensing mechanism. FIG. 2C is a plan view of the bottle taken generally along the line 7-7 of FIG. 1, showing the dip tube 12, the dip tube channel 36 and the bottle side wall 34. The distance between the neck top 32 and the landing 17 can be equal to the bottle fitment length 38, or equal to or greater than the bottle fitment length 38 or can be from 1 to 5 times the bottle fitment length 38, or from 2 to 4 times the bottle fitment length.

Figure 3:
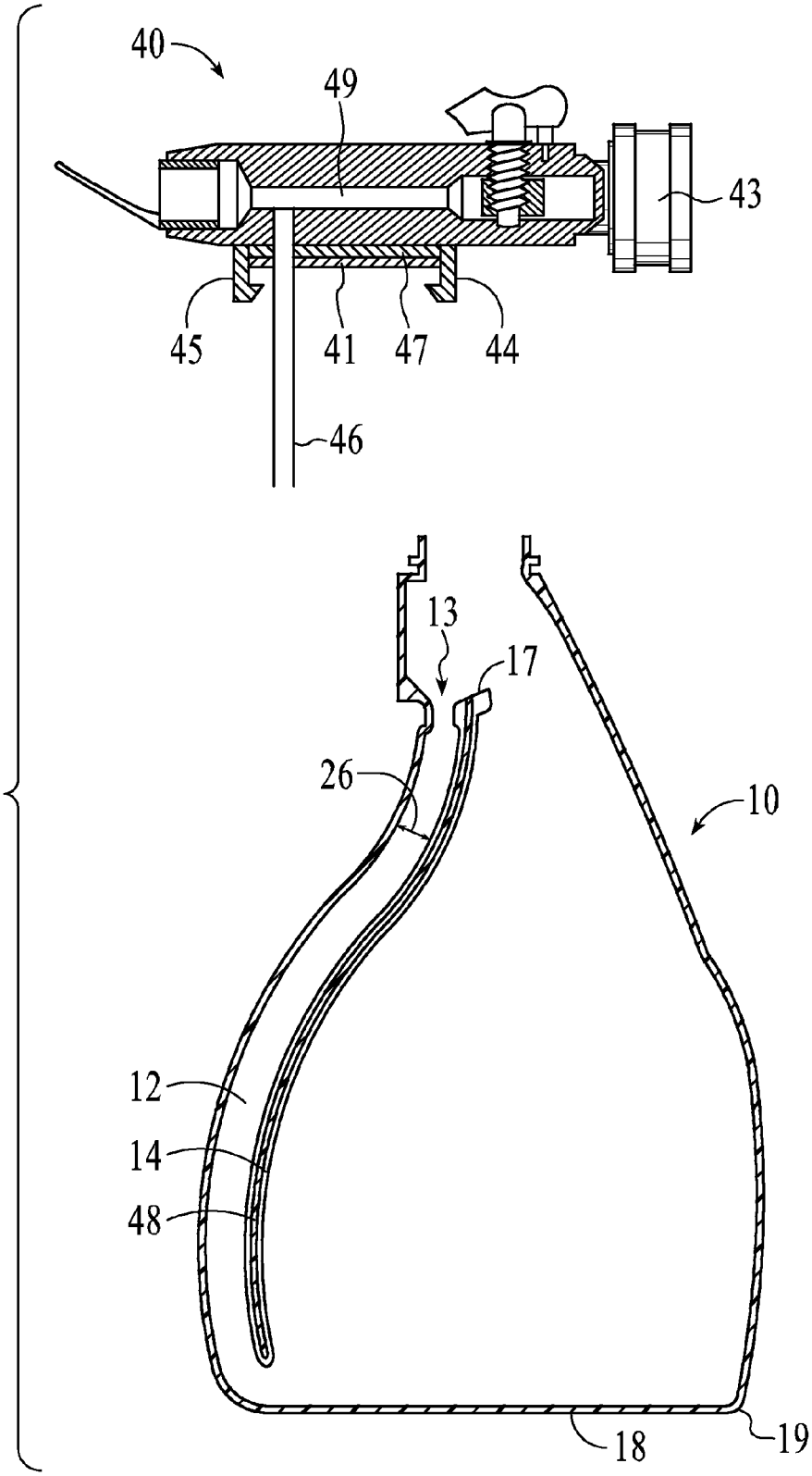
FIG. 3 shows an exploded cross-sectional view of a fluid dispensing mechanism having a hose sprayer mechanism with an attachment assembly, according to the present invention.

In one embodiment, as is shown in cross-sectional view in FIG. 3, the hose dispensing mechanism 40 is a hose sprayer and has a exit port 42, a hose connector 43, a snap-fit bottle connector 44 as part of a snap-fit dispensing attachment assembly 45 and a flexible fluid connector tube 46 supported on the dispensing attachment assembly understructure 47 by a disk support 41. The disk support 41 may snap into the understructure 47. The snap-fit bottle connector 44 may be a bayonet-type attachment and may be removable or non-removable. The flexible fluid connector tube 46 can be attached the integral dip tube top opening 13 at the landing 17 of the bottle 10. The hose sprayer assembly contains a mixing chamber 49 where water from a hose draws liquid up from the dip tube 12 through the flexible fluid connector tube 46 and into the mixing chamber 49 by the venture effect. In this configuration, the front side wall 14 in which the integral dip tube 12 is formed may face downward when fluid from the bottle 10 is expelled therefrom by pointing the front side wall 14 of the bottle 10 downward. In this downward pointing configuration, a small amount of fluid may pool at the intersection of the side wall 14 and the bottom 18, thereby allowing even this small amount of fluid to be drawn up the integral dip tube 12. The bottom back side 19 of the bottle 10 will collect air by pointing the front side wall 14 of the bottle 10 in a downward direction.

The integral dip tube 12 may be completely separated from the sidewall 14 on the exterior of the bottle 10 as in FIG. 1 or there may be a partition wall 48 between the integral dip tube 12 and the bottle sidewall 14 as shown in FIG. 3. It is preferable that the integral dip tube be separated from the front side surface by a partition, since this combination provides increase stiffness to the bottle allowing lighter weight to meet the same load requirements. In one embodiment in FIG. 4A, the integral dip tube 12 is on the interior of the bottle sidewall 14 with a dip tube top opening 13 and a landing 17. A cross-sectional view in FIG. 4B shows that the integral dip tube 12 is on the bottle inside 22.

Figure 5:
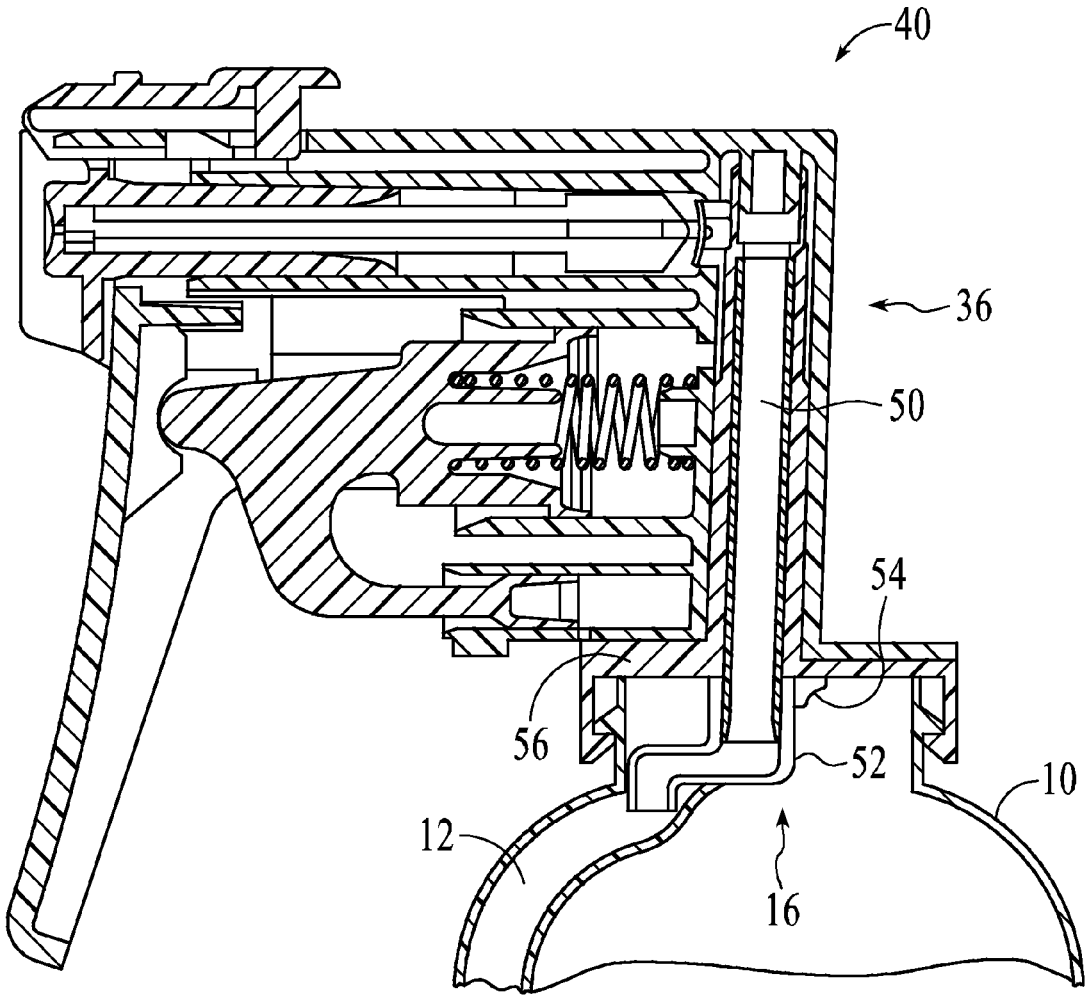
FIG. 5 shows a cross-sectional view of a fluid dispensing mechanism and bottle, according to the present invention.

Regardless of the mechanism of connection between the bottle 10 and the dispensing mechanism 40, the dispensing mechanism 40 of FIG. 5 may have a trigger supply line 50 centrally located about the center axis of the bottle top opening 16. The trigger supply line 50 is fluidly connected to a rotatable connector 52 which can be aligned with the landing 17 and the opening 13 of the integral dip tube 12. The rotatable connector 52 can be supported by a connector support insert 54 in the trigger understructure 56 as in FIG. 5 or the rotatable connector can be held in place by a support disk 58 that snaps into the trigger understructure 56, as in FIG. 6. When the fitment is a bayonet fitment that requires a rotation to lock the fitment, the rotatable connector allows continued alignment with the dip tube as the bayonet fitment is rotated.

Figure 7:
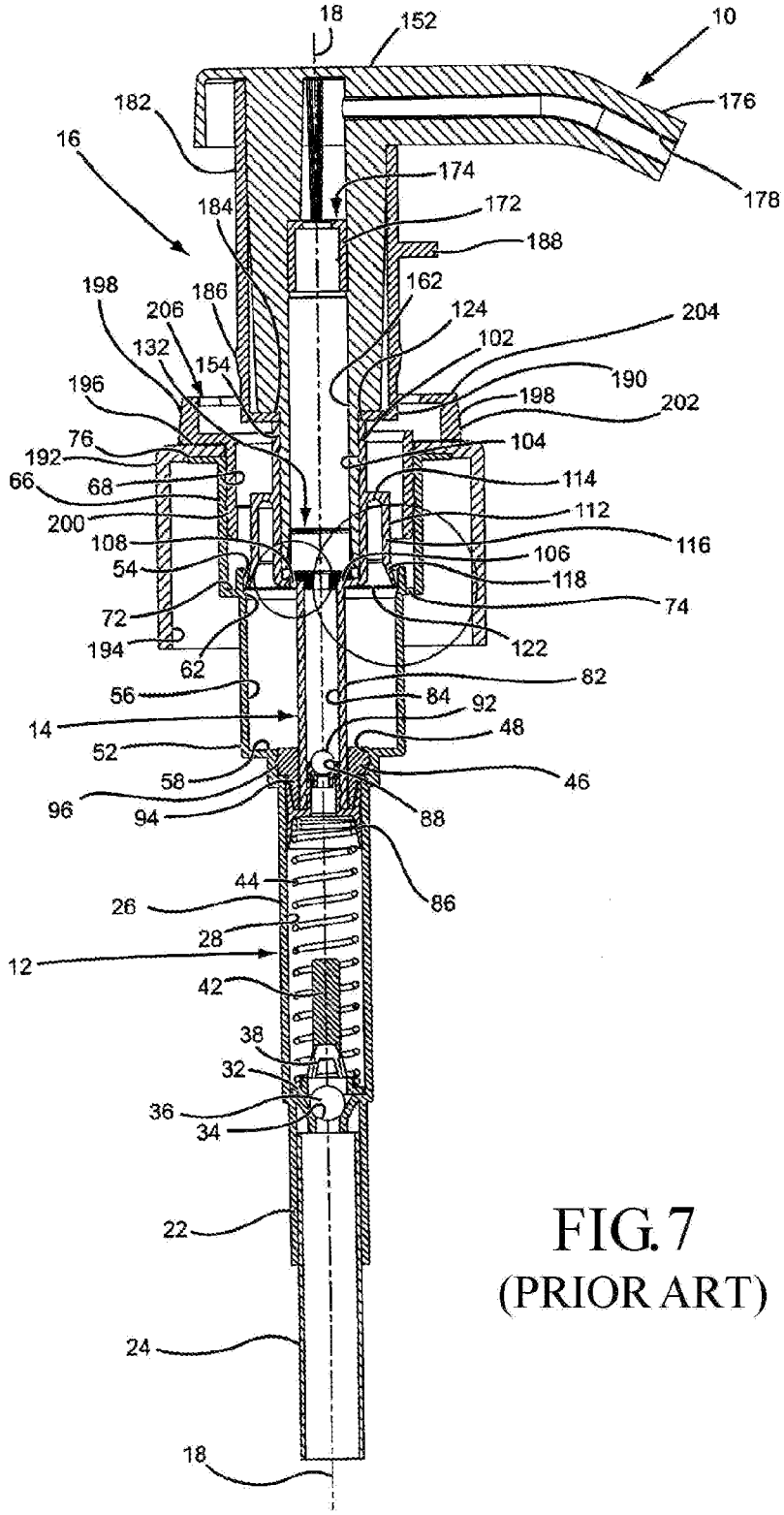
FIG. 7 (PRIOR ART)
FIG. 7 shows a pump mechanism of the prior art.

The trigger dispensing mechanism 40 may be any conventional device, which may be designed to have a standard trigger mechanism, for drawing fluid from a bottle up a dip tube and expelling the fluid outside of the bottle. One example of a trigger-operated sprayer may be as disclosed in U.S. Pat. No. 5,794,822, herein incorporated by reference. The present invention may additionally include a pump mechanism, for example as shown in FIG. 7, and described in U.S. Pat. No. 6,644,516 to Foster et al., and incorporated by reference herein. Furthermore, the present invention includes any fluid dispensing mechanism that may be attached through a snap-fit connection to a bottle with an integral dip tube. In addition, the present invention, in certain embodiments thereof, may not be limited to any particular means for attaching the fluid dispensing mechanism to the bottle.

Figure 6:
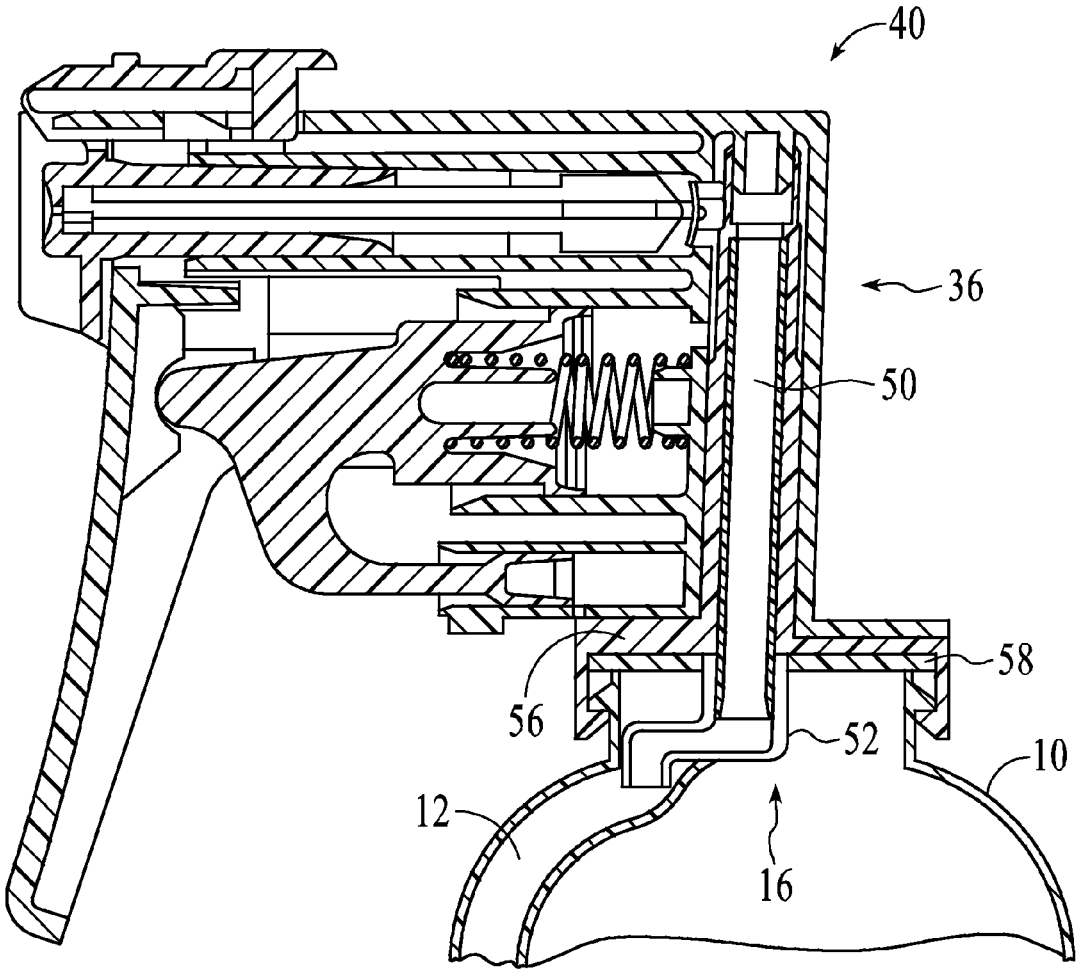
FIG. 6 shows a cross-sectional view of a fluid dispensing mechanism and bottle, according to the present invention.
Figure 8:
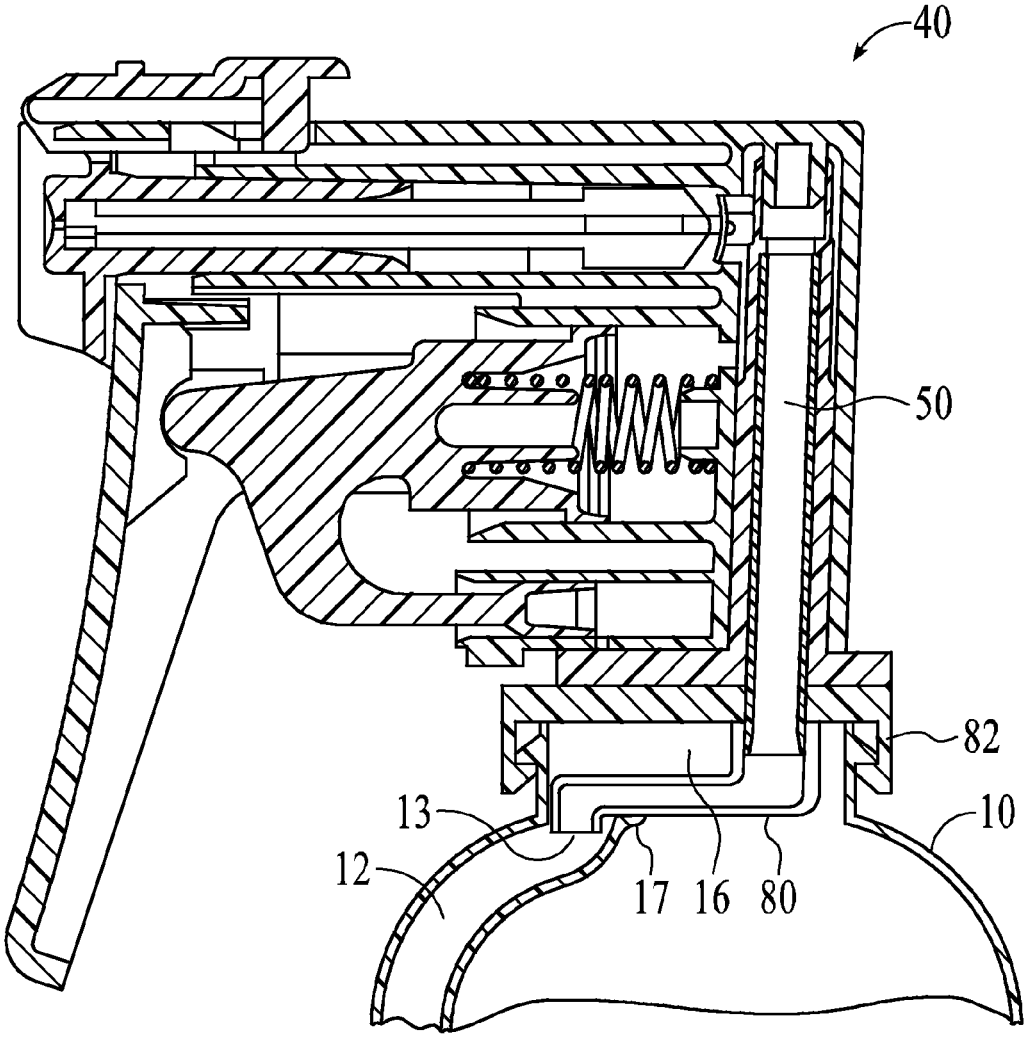
FIG. 8 shows a cross-sectional view of a fluid dispensing mechanism and bottle, according to the present invention.

Similar to the embodiments of FIGS. 5 and 6, the embodiment shown in FIG. 8 has the trigger supply line 50 offset from center but in the back of the trigger dispensing mechanism 40, thereby requiring a connector 80 between the trigger supply line 50 and the integral dip tube opening 13 and landing 17 when the trigger dispensing mechanism 40 is snap-fit onto the bottle 10. Unlike prior art designs, which suggest a rigid connection between the trigger supply line 50 and the dip tube 12, the combination of an offset trigger supply line 50 and a snap-fit connection 82 requiring rotation to lock requires that the connector 80 must be flexible in order to stay aligned with both the trigger supply line 50 and the dip tube 12. It also requires that the dip tube opening 13 be located below the bottle top opening 16. The landing 17 also helps maintain alignment. While the connector 80 must be flexible to rotation, the connector 80 must also maintain its shape in a vertical direction. As shown in the embodiment in FIG. 9, this can be facilitated by a support disk 86 that can be snap-fit into trigger understructure 56.

Figure 9:
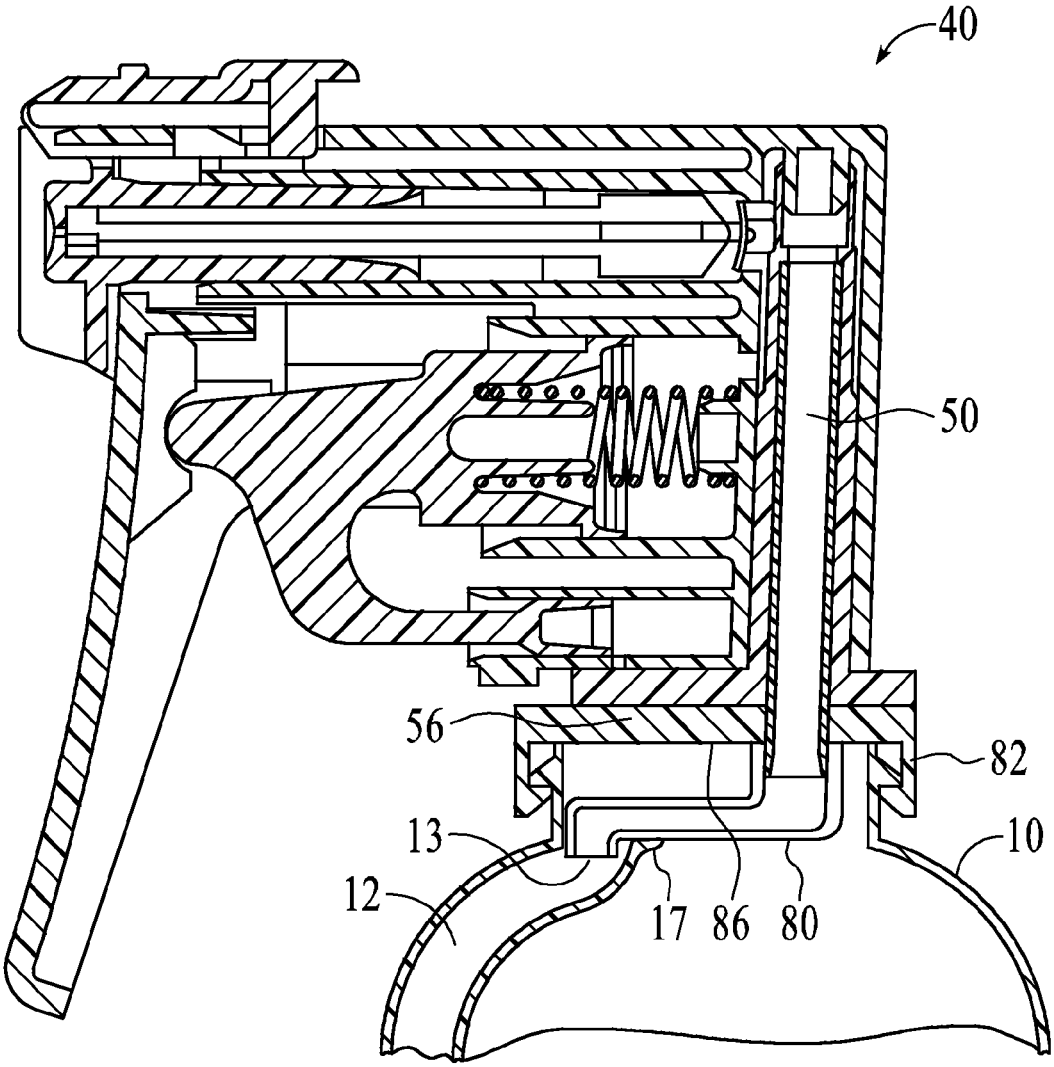
FIG. 9 shows a cross-sectional view of a fluid dispensing mechanism and bottle, according to the present invention.
Figure 10:
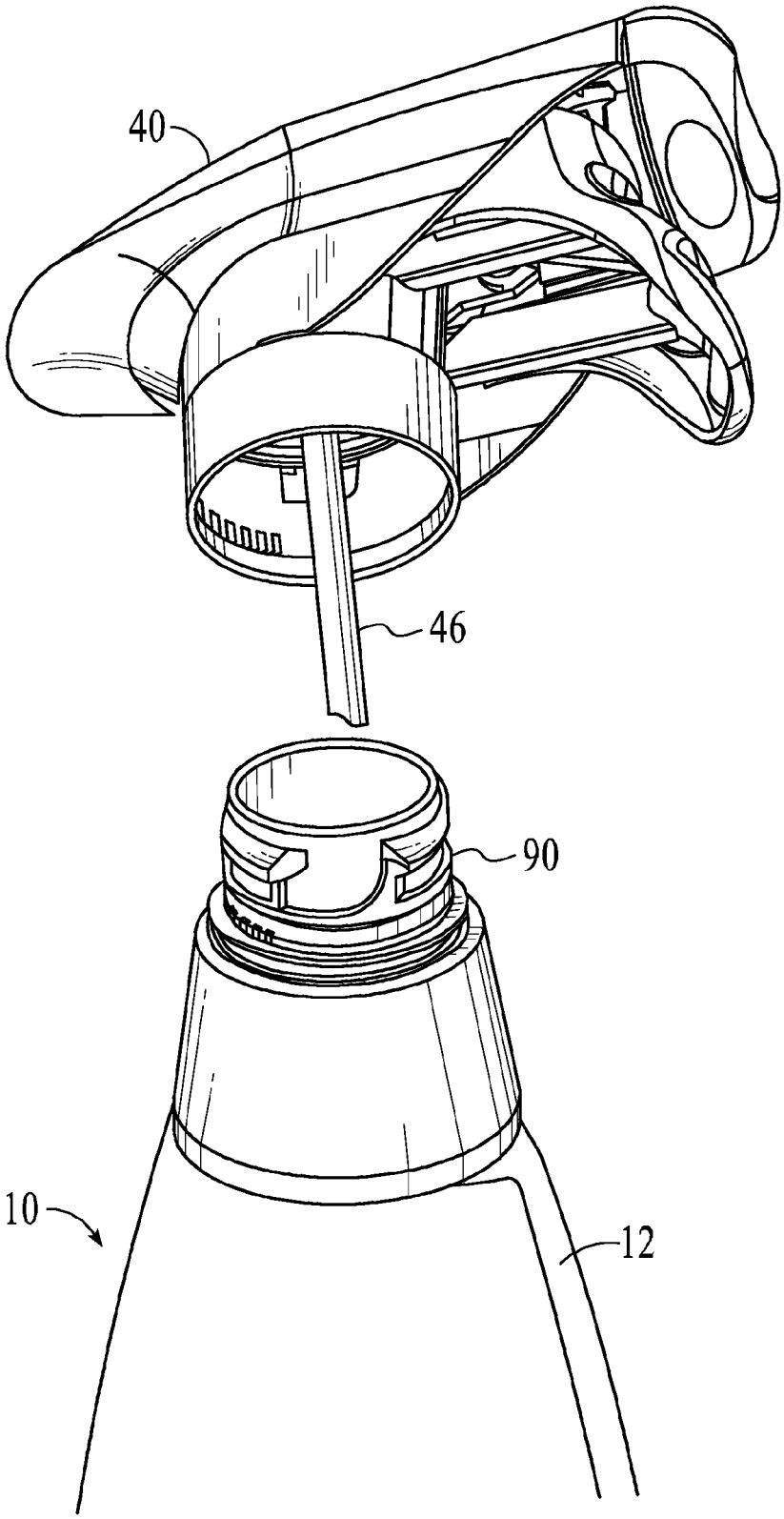
FIG. 10 shows a perspective view of a fluid dispensing mechanism and bottle, according to the present invention.
Figure 11:
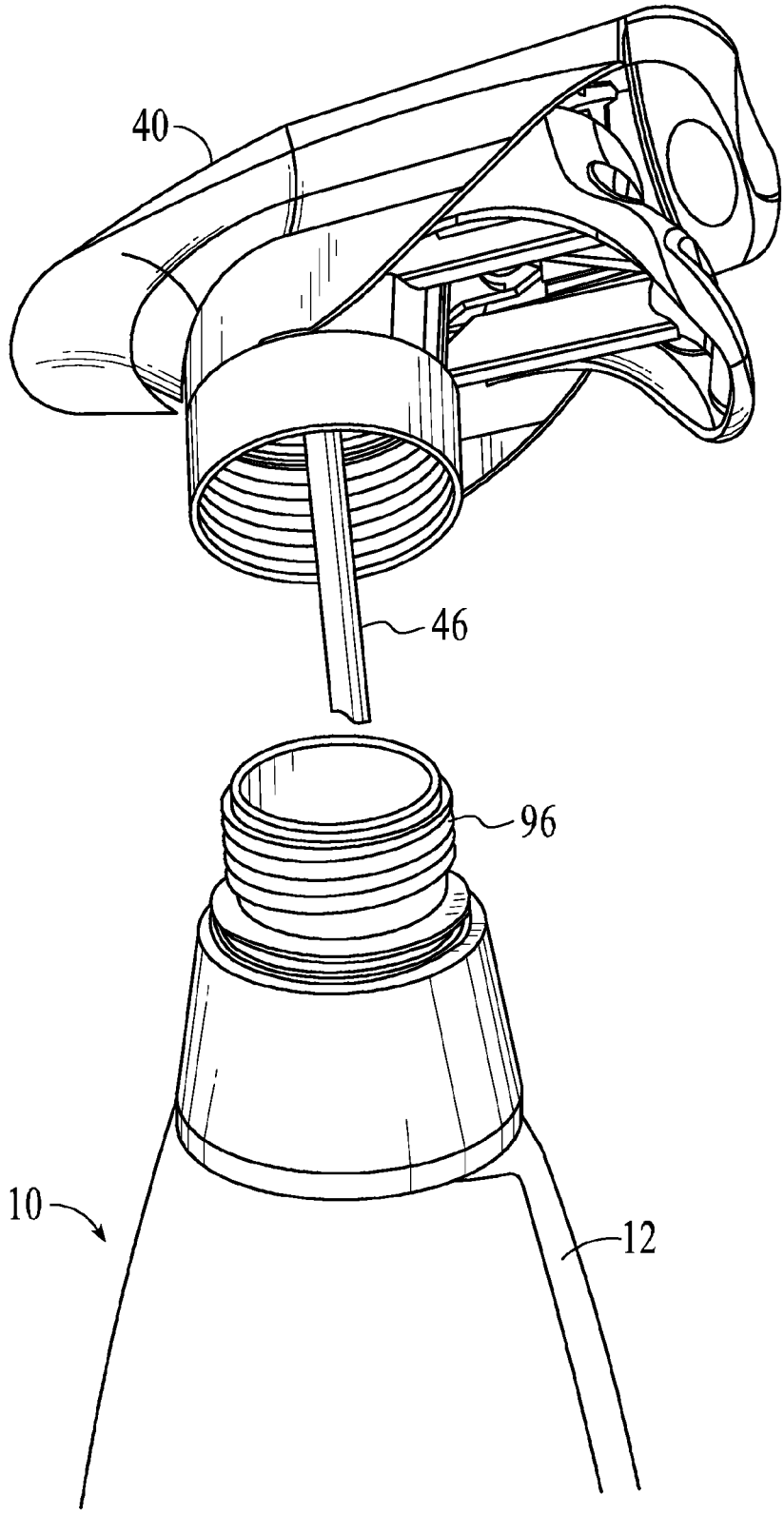
FIG. 11 shows a perspective view of a fluid dispensing mechanism and bottle, according to the present invention.

The trigger dispensing mechanism may be attached to the bottle by any typical means. Referring now to FIG. 10, there is shown a further example of a bottle 10 having an integral dip tube 12 and a bayonet neck fitment 90. Bayonet-type fitments, such as those disclosed in, for example, U.S. Pat. No. 6,138,873 and U.S. Pat. No. 6,226,068, may be useful in the present invention for attaching the trigger dispensing mechanism 40 with the bottle 10. One example of a snap-fit mechanism that may be useful in the present invention is described in commonly owned U.S. patent application Ser. No. 12/142,090, herein incorporated by reference. In one embodiment, the trigger dispensing mechanism 40 may be snap-fit connected to the top opening 16 of the bottle 10 such that it is non-removable, as shown in FIG. 9. Alternatively, the trigger dispensing mechanism 40 may be attached to the bottle 10 having a threaded fitment 96 by a threaded connection as shown in FIG. 11.

The above described examples of embodiments of the present invention may impart several advantages over conventional dispensers presently being sold. The use of a snap-fit fluid dispensing mechanism may provide, once the fluid dispensing mechanism is aligned with the bottle, for alignment of the trigger supply line with the integral dip tube as well as attachment and sealing of the fluid dispensing mechanism with the bottle, with a single motion. Conventional bottles with integral dip tubes have screw caps that require a user to first align the fluid dispensing mechanism with the dip tube and then twist the cap to provide a seal. These conventional bottles also require the user to maintain the alignment of the dip tube with the fluid dispensing mechanism while the screw cap is tightened onto the bottle. In conventional bottles, the alignment of the dip tube with the fluid dispensing mechanism may be lost due to the torque applied to the screw cap. The snap-fit fluid dispensing mechanism of the present invention, when applied to a bottle having an integral dip tube, may be simply snapped in place, without the need to apply torque to the cap to seal the cap, as is required with conventional screw caps.

Moreover, these conventional bottles require a means to move the fluid from the side of the open top part of the bottle (where the integral dip tube is located), to a central portion of the trigger mechanism. With the use of a forward trigger mechanism according to the present invention, as described above, this fluid moving means otherwise required by conventional bottles may be avoided.

This invention has been described herein in detail to provide those skilled in the art with information relevant to apply the novel principles and to construct and use such specialized components as are required. However, it is to be understood that the invention can be carried out by different equipment, materials and devices, and that various modifications, both as to the equipment and operating procedures, can be accomplished without departing from the scope of the invention itself.

I claim:

1. A fluid dispensing container comprising:

a bottle having a front side surface, a back side surface, a bottom, a neck top, a bottle fitment below the neck top, and an interior volume, wherein a dip tube is integrally formed exterior to the front side surface, separated from the front side surface by a partition, and fluidly connected to the interior volume at the bottom and fluidly connected to the interior volume at a landing below the neck top; and a hose sprayer assembly having a snap-fit dispensing attachment assembly attached to the bottle neck by a snap-fit fitting and fluidly connected to the dip tube at the landing and a hose connector, wherein the dispensing attachment assembly is fluidly connected to a mixing chamber of the sprayer assembly.

2. The fluid dispensing container of claim 1, wherein the distance between the neck top and the landing is equal to or greater than the bottle fitment length.

3. The fluid dispensing container of claim 1, wherein the landing is funnel shaped, instead of flat, with one or both sides of the landing slanting inward towards a dip tube top opening.

4. The fluid dispensing container of claim 1, wherein the snap-fit attachment is a bayonet-type attachment.

5. The fluid dispensing container of claim 1, wherein the snap-fit attachment is a non-removable snap-fit attachment.

6. A fluid dispensing container comprising:

a bottle having a front side surface, a back side surface, a bottom, a neck top defining a bottle opening having a first axial center, a bottle fitment below the neck top, and an interior volume, wherein a dip tube is integrally formed to the front side surface and fluidly connected to the interior volume at the bottom and fluidly connected to the interior volume at a landing below the neck top; and a hose sprayer assembly having a snap-fit dispensing attachment assembly attached to the bottle neck by a snap-fit fitting and fluidly connected to the dip tube at the landing wherein the landing is funnel shaped, instead of flat, with one or both sides of the landing slanting inward towards a dip tube top opening having a second axial center, the second axial center aligned generally parallel to and radially offset from the first axial center of the bottle opening; and wherein the dispensing attachment assembly is fluidly connected to a mixing chamber of the sprayer assembly.

7. The fluid dispensing container of claim 6, wherein the snap-fit dispensing attachment assembly includes a separate flexible connector fluidly connecting the dispensing mechanism with the dip tube at the landing.

8. The fluid dispensing container of claim 7, wherein the flexible connector is supported on the understructure.

9. The fluid dispensing container of claim 8, wherein the flexible connector is supported on the understructure by a disk that snaps into the understructure.

10. The fluid dispensing container of claim 6, wherein the distance between the neck top and the landing is equal to or greater than the bottle fitment length.

11. The fluid dispensing container of claim 6, wherein the snap-fit attachment is a bayonet-type attachment.

12. The fluid dispensing container of claim 6, wherein the snap-fit attachment is a non-removable snap-fit attachment.

13. The fluid dispensing container of claim 6, wherein the mixing chamber is fluidly connected to the hose attachment.

14. A fluid dispensing container comprising:

a bottle having a front side surface, a back side surface, a bottom, a neck top, a bottle fitment below the neck top, and an interior volume, wherein a dip tube is integrally formed exterior to the front side surface, separated from the front side surface by a partition, and fluidly connected to the interior volume at the bottom and fluidly connected to the interior volume at a landing below the neck top;

a hose sprayer assembly having a snap-fit dispensing attachment assembly attached to the bottle neck by a snap-fit fitting and fluidly connected to the dip tube at the landing wherein the landing is funnel shaped, instead of flat, with one or both sides of the landing slanting inward towards a dip tube top opening and wherein the dispensing attachment assembly is fluidly connected to a mixing chamber of the sprayer assembly wherein the snap-fit dispensing attachment assembly includes a separate flexible connector fluidly connecting the hose dispensing mechanism with the dip tube at the landing.

15. The fluid dispensing container of claim 14, wherein the flexible connector is supported on the understructure.

16. The fluid dispensing container of claim 15, wherein the flexible connector is supported on the understructure by a disk that snaps into the understructure.

17. The fluid dispensing container of claim 14, wherein the distance between the neck top and the landing is equal to or greater than the bottle fitment length.

18. The fluid dispensing container of claim 14, wherein the snap-fit attachment is a bayonet-type attachment.

19. The fluid dispensing container of claim 14, wherein the flexible connector directly aligns with the integral dip tube when the snap-fit fluid dispensing mechanism is attached to the bottle.

* * * * *